US005315963A

United States Patent [19]

Warf

[11] Patent Number: 5,315,963

[45] Date of Patent: May 31, 1994

[54] SLEEVE-TYPE ROTARY VALVE FOR AN INTERNAL COMBUSTION ENGINE

[76] Inventor: Donald W. Warf, 104 Melody La., Winchester, Tenn. 37398

[21] Appl. No.: 45,734

[22] Filed: Apr. 14, 1993

[51] Int. Cl.[5] ..... F01L 7/02

[52] U.S. Cl. ..... 123/190.012; 123/80 C

[58] Field of Search ..... 123/190.1, 190.12, 190.4, 123/80 C

[56] References Cited

U.S. PATENT DOCUMENTS

| | | | |
|---|---|---|---|
| 996,339 | 6/1911 | Hoiland . | |
| 1,096,683 | 5/1914 | Clough | 123/190 |
| 1,213,316 | 1/1917 | Well | 123/190 |
| 1,584,348 | 3/1923 | Astrom | 123/190 |
| 1,718,775 | 3/1927 | Charter | 123/190 |
| 1,817,624 | 1/1928 | Higley | 123/190 |
| 2,017,196 | 4/1931 | Anglada et al. | 123/190 |
| 2,273,179 | 2/1942 | Davison | 123/80 C |
| 2,401,932 | 6/1946 | Heintz | 123/190 C |
| 2,855,912 | 10/1958 | Stucke | 123/190 |
| 3,948,241 | 4/1976 | Melchoir | 123/80 C |
| 4,481,917 | 11/1984 | Rus et al. | 123/190 C |
| 4,612,886 | 9/1986 | Hansen et al. | 123/190.4 |
| 4,949,685 | 8/1990 | Doland et al. | 123/190 A |
| 4,969,918 | 11/1990 | Taniguchi | 123/190 A |
| 5,052,349 | 1/1991 | Buelna | 123/190 E |
| 5,095,870 | 3/1992 | Place et al. | 123/190.4 |
| 5,105,784 | 3/1992 | Davis et al. | 123/337 |
| 5,109,814 | 5/1992 | Coates | 123/190.14 |
| 5,127,376 | 7/1992 | Lynch | 123/190.2 |
| 5,152,259 | 10/1992 | Bell | 123/190.2 |
| 5,154,147 | 10/1992 | Muroki | 123/190.17 |

FOREIGN PATENT DOCUMENTS

| | | |
|---|---|---|
| 678268 | 6/1939 | Fed. Rep. of Germany . |
| 184777 | 6/1955 | Fed. Rep. of Germany . |
| 0221841 | 9/1924 | United Kingdom . |
| 284941 | 3/1928 | United Kingdom . |

*Primary Examiner*—Noah P. Kamen
*Assistant Examiner*—Erick Solis
*Attorney, Agent, or Firm*—Cushman, Darby & Cushman

[57] ABSTRACT

An internal combustion engine is provided including at least one cylinder having at least one inlet port and at least one exhaust port; a piston mounted in the at least on cylinder for reciprocated movement therein, the piston having a piston rod; a crankshaft coupled to the piston rod for converting the reciprocating movement of the piston to rotational movement; a cylindrical sleeve surrounding an outside wall of a portion of the cylinder; and mounting structure for mounting the cylindrical sleeve for rotation with respect to the cylinder. The cylindrical sleeve has at least one slot defined therethrough which aligns periodically with the ports of the cylinder upon rotation of the cylindrical sleeve. The mounting structure includes low-friction bearing structure to minimize friction between the cylinder and the sleeve. A gear train is provided for rotating the cylindrical sleeve relative to movement of the crankshaft.

18 Claims, 7 Drawing Sheets

SLEEVE-TYPE ROTARY VALVE FOR AN INTERNAL COMBUSTION ENGINE

BACKGROUND OF THE INVENTION

1. Field of the Invention

The present invention relates to a rotary valve and, more particularly, to the rotary valve mechanism for a piston cylinder provided with one or more cylinders operating in a two-stroke or four-stroke cycle internal combustion engine.

2. Description of Related Art

In conventional internal combustion engines it is necessary to charge the cylinder with a fuel air mixture for a combustion cycle and to vent exhaust gases at the end of an exhaust cycle for each cylinder of the engine. In a typical piston cylinder engine, these events occur thousands of times per minute, per cycle. In conventional internal combustion engines, rotation of a camshaft causes spring loaded poppet valves to open and enable fuel/air mixture to flow from the carburetor to the cylinder in a combustion chamber during an intake stroke. The camshaft closes the intake valve during the compression and combustion stroke of the cylinder and opens a second spring loaded poppet valve, the exhaust valve, to evacuate the cylinder after compression and combustion have occurred. Exhaust gases then exit the cylinder and enter the exhaust manifold.

The spring loaded poppet valve assemblies include springs, rockers, guides, shafts and the valves themselves, mounted for reciprocating motion which reduces the energy output obtained by the engine. Manufacturing these poppet valves is costly due to the number and necessary precision of the mechanical parts involved.

As engine revolution increases, the poppet valves of course open and close more frequently. This demands tight tolerances and precise timing in order to prevent contact of the piston with an open valve. Thus, maintenance and adjustment is frequently required for the poppet valve engines.

The poppet valves themselves retain a great deal of heat during operation, and improper fuel detention may take place which results in a dieseling effect. One cure for such a problem is the use of more expensive, high octane fuel.

Rotary valves have been known for many years and are used in some engines in place of poppet valves to reduce the number of moving parts and reduce friction, thus increasing engine efficiency. However, in conventional rotary valves, it is common to have a metal-to-metal contact between the rotor valve and the and the cylinder which creates friction, thus increasing heat and reducing efficiency. Further, when ignition takes place, the explosion is typically exerted directly on the rotary valve. This can lead to sealing problems and may increase valve stress.

SUMMARY OF THE INVENTION

An object of the present invention is to provide a sleeve-type rotary valve assembly for internal combustion engine which overcomes the problems of poppet valves and yet does not suffer the deficiencies of prior rotary valves. A further object of the invention is to provide a sleeve-type rotary valve that is inexpensive to manufacture and assemble, and is effective in operation. In accordance with the principles of the present invention, these objectives are realized by providing an internal combustion engine including at least one cylinder having at least one inlet port and at least one exhaust port; a piston mounted in the at least one cylinder for reciprocated movement therein, the piston having a piston rod; a crankshaft coupled to the piston rod for converting the reciprocating movement of the piston to rotational movement; a cylindrical sleeve surrounding an outside wall of a portion of the cylinder; and mounting structure for mounting the cylindrical sleeve for rotation with respect to the cylinder. The cylindrical sleeve has at least one slot defined therethrough which aligns periodically with the ports of the cylinder upon rotation of the cylindrical sleeve. The mounting structure includes low-friction components to maintain low-friction between the cylinder and the sleeve. A gear train is provided for rotating the cylindrical sleeve relative to movement of the crankshaft.

Another objective of the present invention is to provide solid lubrication bearings between the rotary sleeve and the cylinder to reduce friction and, thus, the build-up of heat.

A further object of the invention is to ensure that fuel ignition takes place after the piston dome has passed the cylinder's intake and exhaust ports, whereby an explosion is not placed directly on the valve during operation.

Other objects, features and characteristics of the present invention, as well as the function of the related elements of structure, and a combination of parts and economies of manufacture, will become more apparent upon consideration of the following detailed description and the appended claims with reference to the accompanying drawings all of which form a part of the specification.

DETAILED DESCRIPTION OF THE PRESENTLY PREFERRED EXEMPLARY EMBODIMENT

Figure 1:
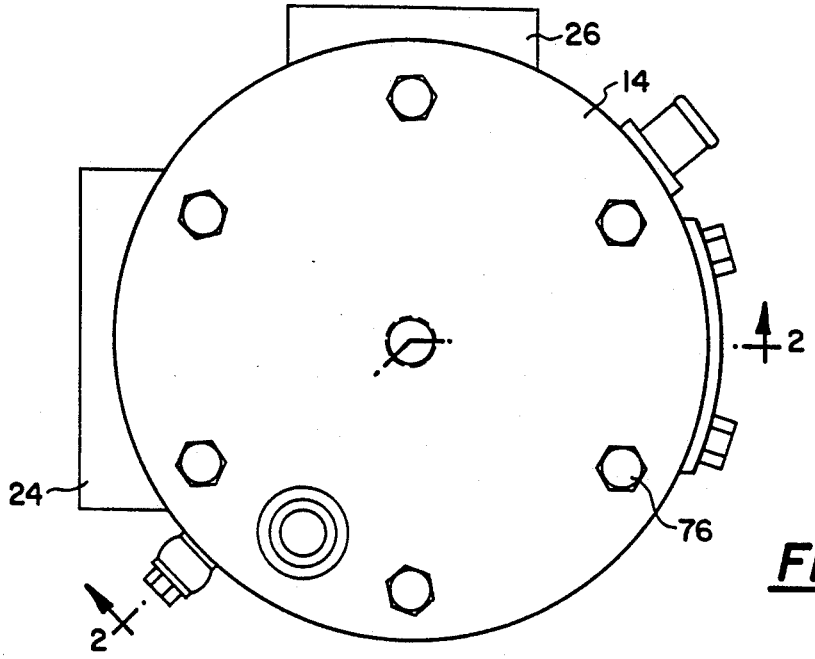
FIG. 1 is a plan view of a sleeve-type rotary valve assembly embodying the principles of the present invention.
Figure 2:
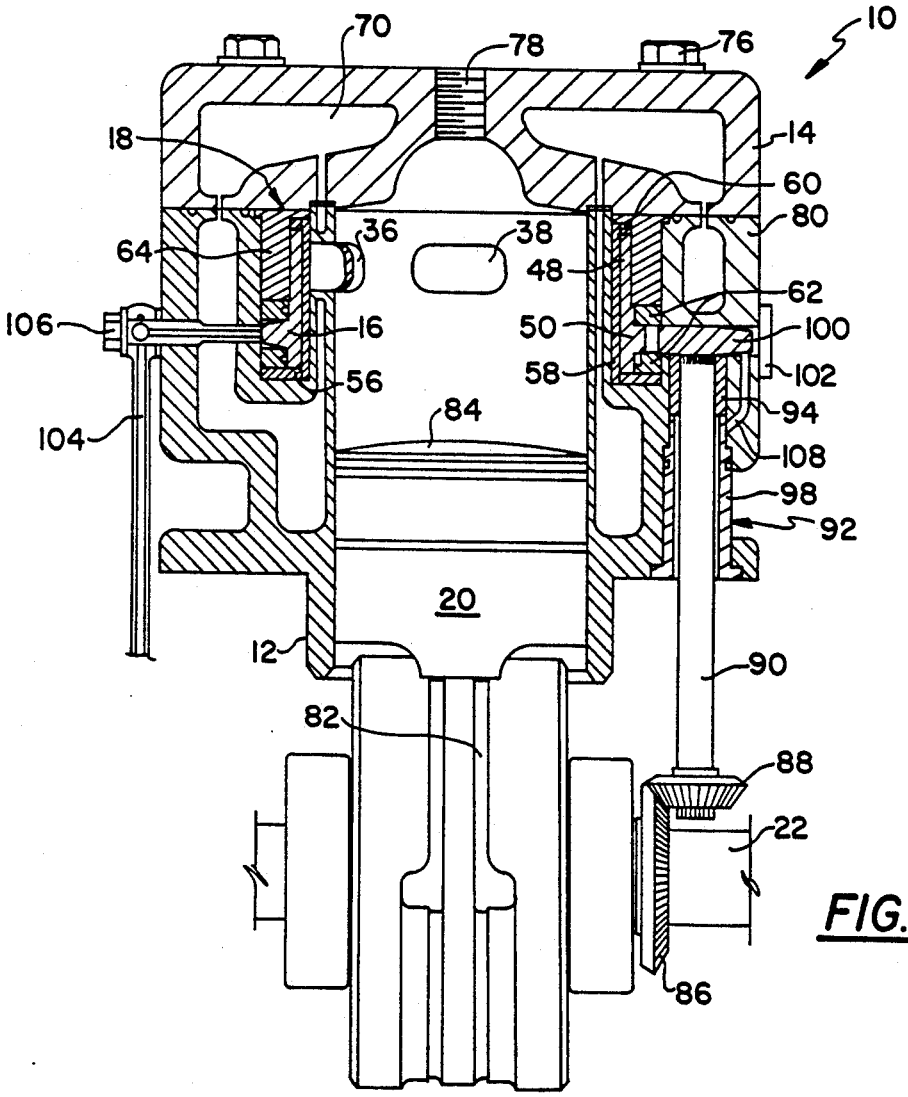
FIG. 2 is a cross-sectional view taken along the line 2—2 of FIG. 1.
Figure 3:
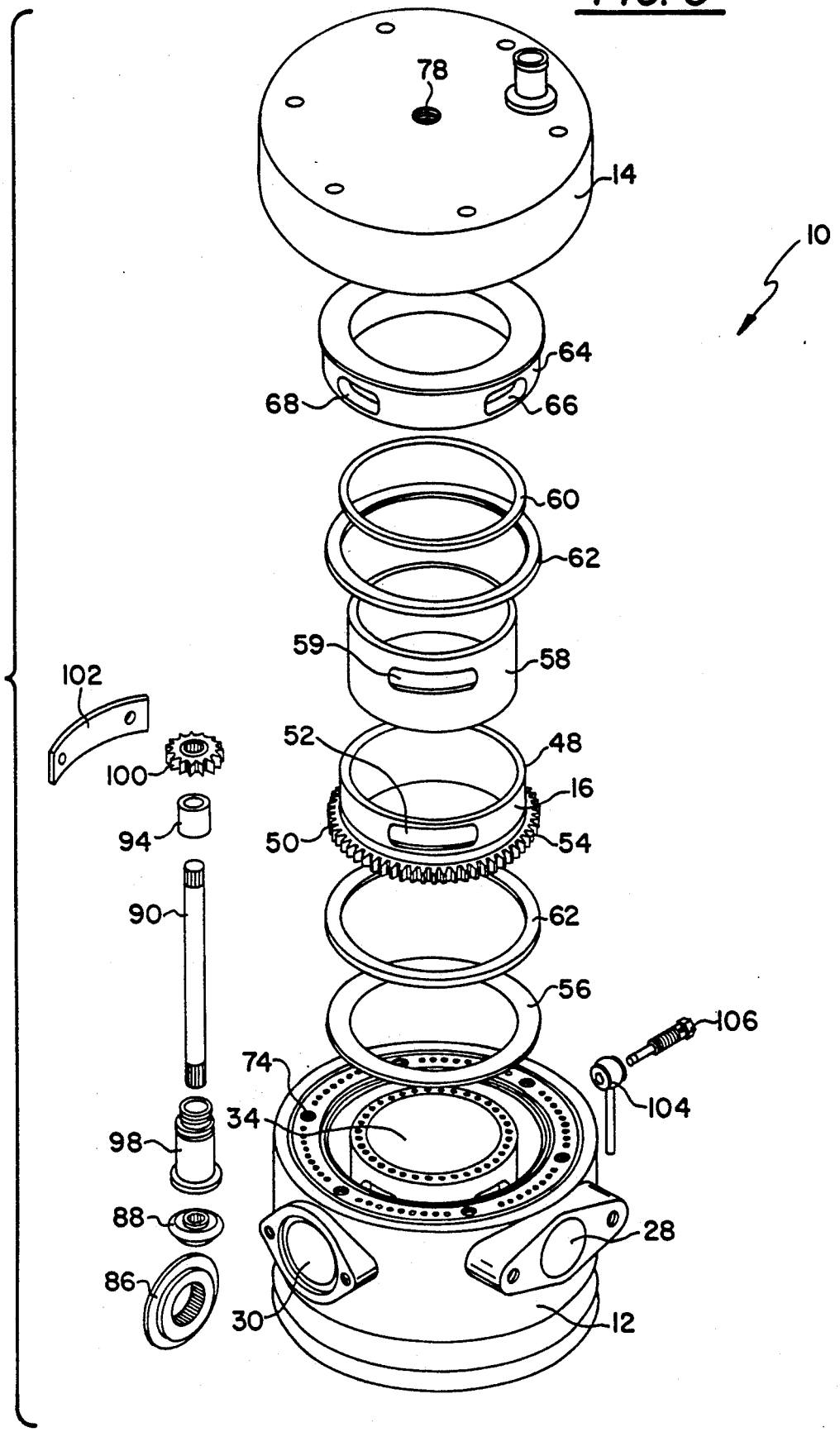
FIG. 3 is an exploded perspective view of a rotary valve provided in a cylinder in accordance with the principles of the present invention, shown with the piston removed for FIG. 4 is a plan view of the sleeve-type rotary valve and cylinder shown with the spacer, cylinder head, thrust bearing and oil seal removed for clarity.
Figure 4:
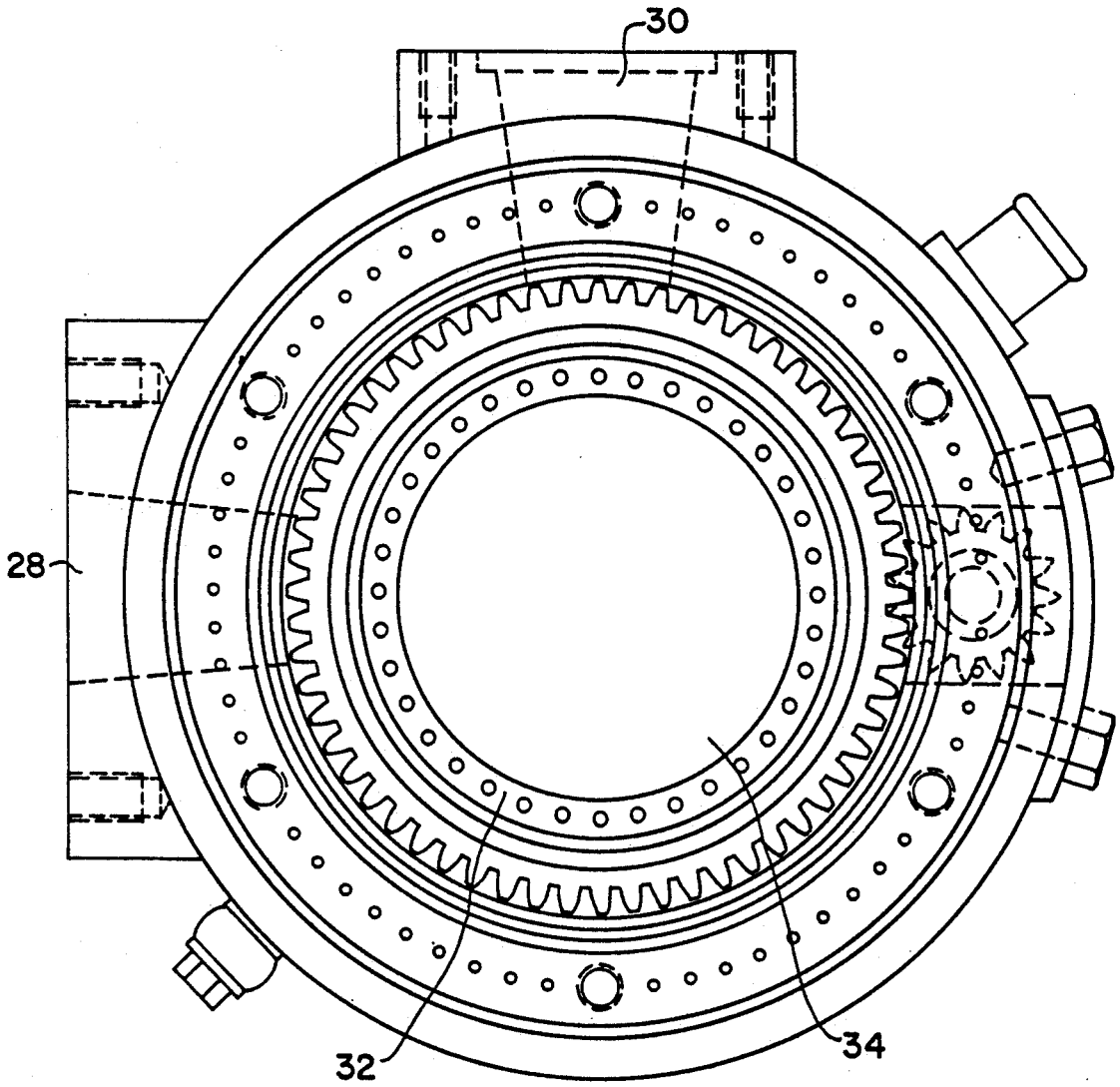
Figure 5:
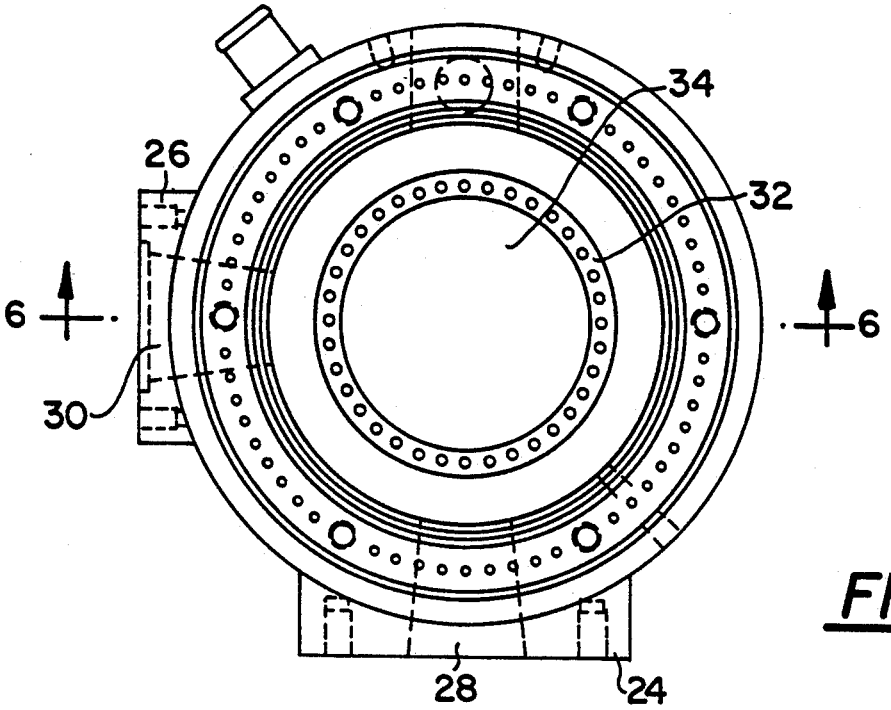
FIG. 5 is a plan view of the cylinder provided in accordance with the principles of the present invention.
Figure 6:
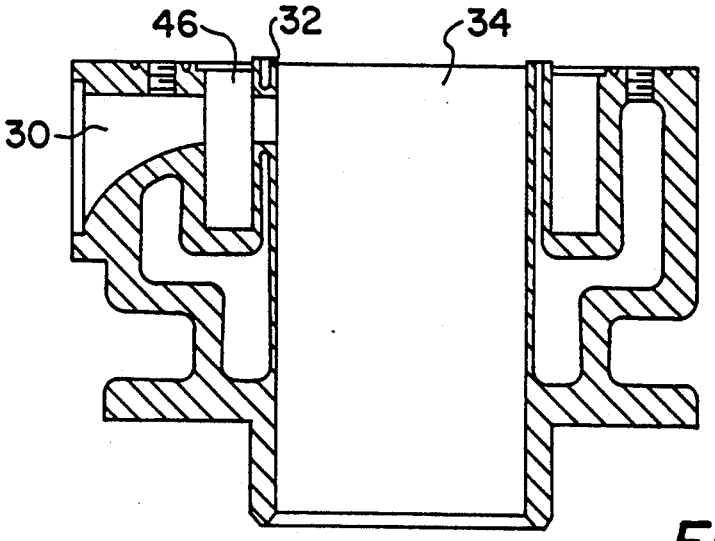
FIG. 6 is a cross-sectional view taken along the line 6—6 of FIG. 5.
Figure 7:
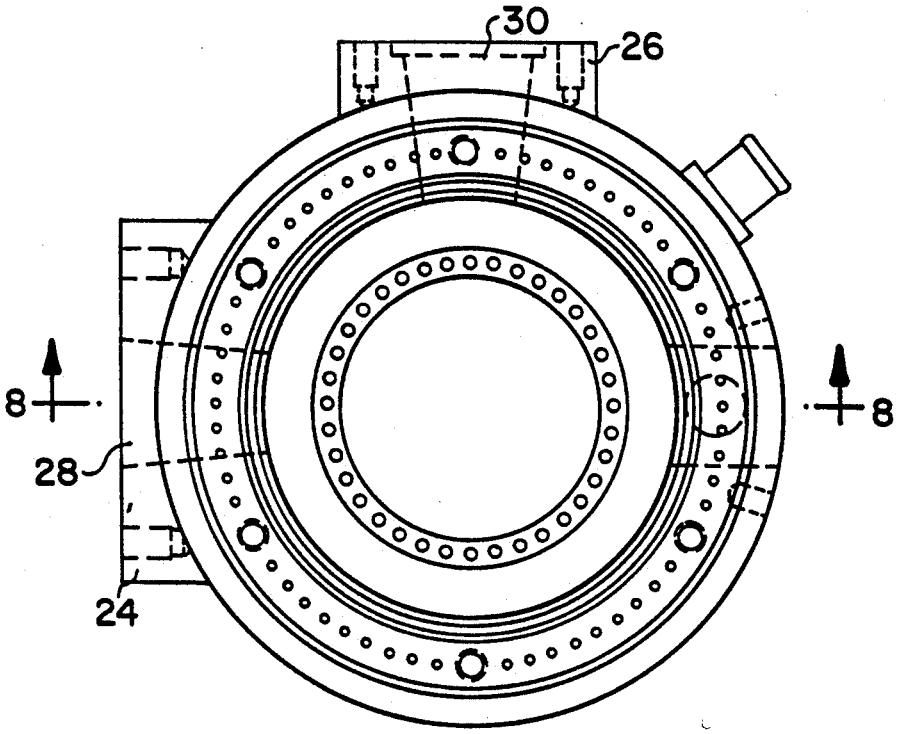
FIG. 7 is a plan view of the cylinder of the present invention.

Referring to FIGS. 2 and 3, a sleeve-type rotary valve assembly for an internal combustion engine, generally indicated at 10 is shown, which embodies the principles of the present invention. The assembly 10 includes a cylinder 12, cylinder head 14, sleeve rotary valve 16, mounting structure generally indicated at 18, piston 20 and crankshaft 22.

Referring to FIGS. 5–10, the cylinder 12 is preferably constructed as a one piece body. The cylinder is preferably made from 6061 T6 aluminum having surfaces where the piston, rings and bearing contact, nickel plated a thickness of 0.020 inches, and carbide coated for hardness and wear purposes. The cylinder includes an intake flange 24 and an exhaust flange 26. Each flange includes a respective intake bore 28 and exhaust bore 30 therethrough. The cylinder includes an internal cylindrical member 32 having a bore 34 therethrough for receiving the piston. Cylinder member 32 includes an intake port 36 and an exhaust port 38 which respectively align with the intake and exhaust bores 28, 30.

Figure 10:
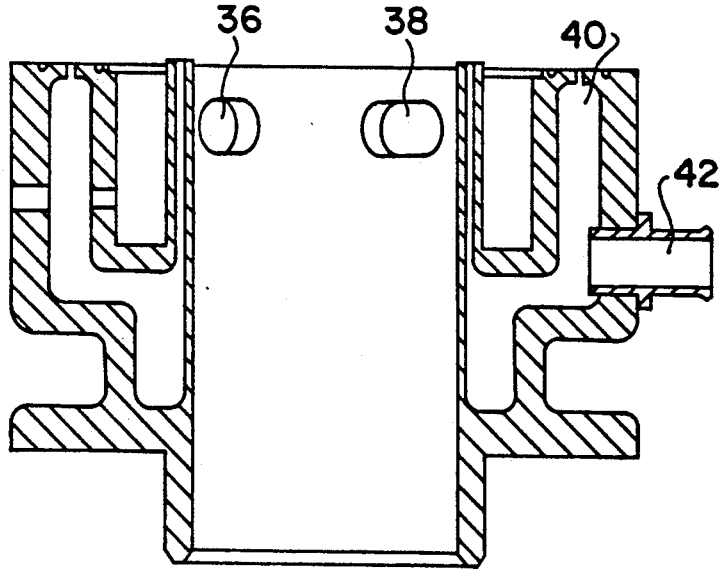
FIG. 10 is a cross-sectional view taken along the line 10—10 of FIG. 9.
Figure 11:
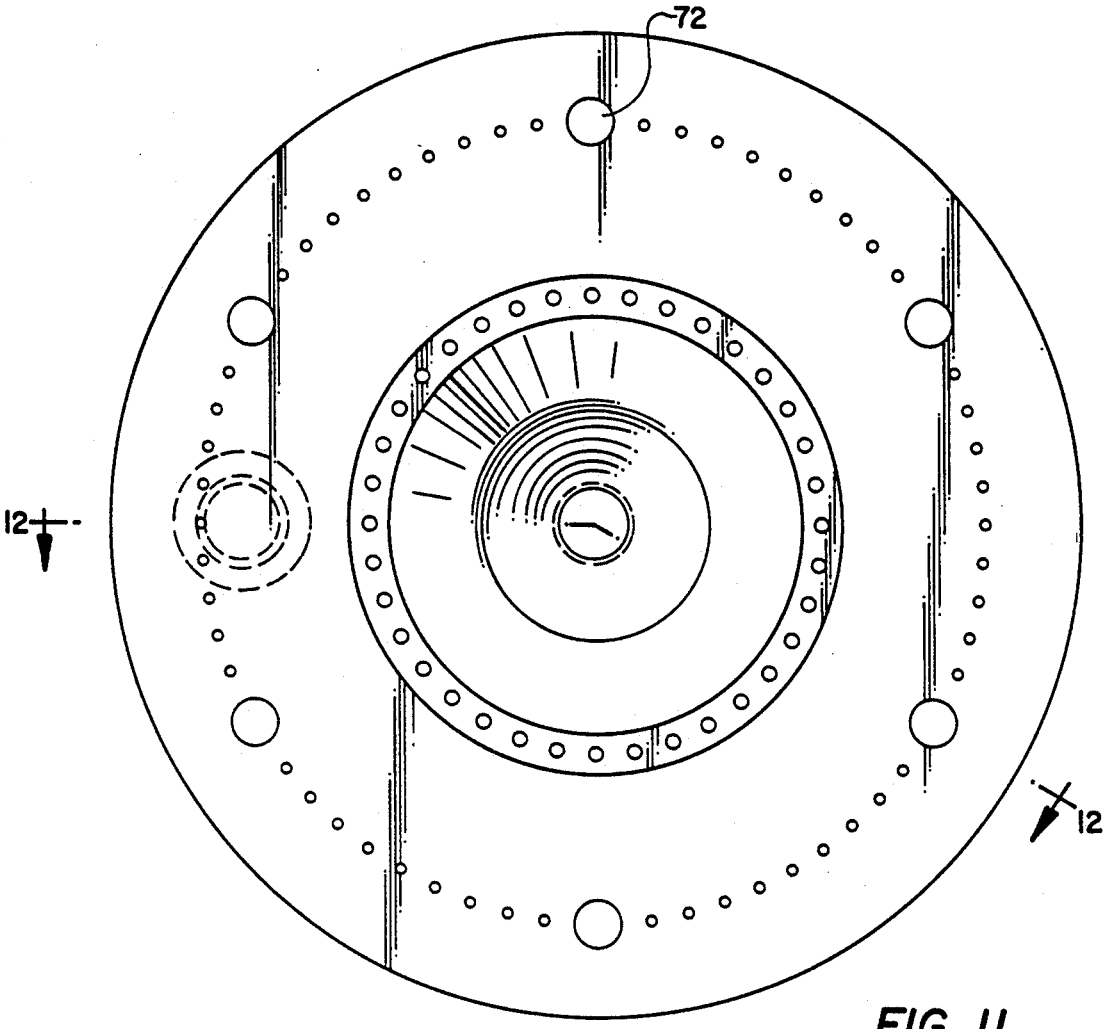
FIG. 11 is a plan view of a cylinder head provided in accordance with the principles of the present invention.

Referring to FIG. 10, the cylinder 12 includes a water reservoir 40 for accommodating the circulation of water to cool the assembly 10. A water port 42 is disposed in a side of the cylinder and a second water port 42 (FIG. 12) is disposed in the cylinder head 14 permitting water to circulate.

An annular channel 46 (FIG. 6) is defined about the periphery of the cylindrical member 32. As shown in FIGS. 2 and 3, the sleeve-type rotary valve 16 is disposed within the channel 46. The rotary valve 16 is of substantially cylindrical configuration and includes an upper portion 48 and a lower portion 50. The upper portion has a slot 52 therein. The lower portion includes a gear-tooth structure 54 disposed about the periphery of the cylindrical member and extends therefrom. The slot 52 of the rotary valve is mounted so as to periodically align with the ports 36, 38 of the cylindrical member upon rotation of the rotary valve 16, as will become more apparent below.

The rotary valve 16 is mounted within the annular channel 46 so that it does not directly contact the outer peripheral surface of the cylindrical member 32. To accomplish this, a mounting structure, generally indicated at 18 is provided. As shown in FIGS. 2 and 3, the mounting structure includes a annular thrust bearing member 56 disposed between a bottom surface of the channel 46 and a lower surface of the sleeve-type rotary valve 16. A sleeve thrust bearing member 58 is disposed between the inner peripheral surface of the rotary valve and the outer peripheral surface of the cylindrical member 32. The sleeve bearing member 58 includes a slot 59 which is sized and located so as to correspond with the 52 slot of the rotary valve 16. As will be appreciated below, the sleeve bearing member 58 and the rotary valve 16 are preferably bonded together and rotate in unison so that each slot is properly aligned. The mounting structure further includes a thrust bearing member 60 disposed about the upper surface of the rotary valve. Preferably, each thrust bearing member 56, 58, 60 is made from a carbon and graphite composite providing lubrication between the rotary valve 16 and the cylindrical member 32, without metal-to-metal contact therebetween. In the illustrated embodiment, two oil seal rings 62 are provided about the periphery of the lower portion of the rotary sleeve 16.

The mounting assembly also includes a spacer 64 which is disposed in the annular channel 46, as shown in FIG. 2. As shown in FIG. 3, the spacer 64 is cylindrical member having an intake port 66 and an exhaust port 68. The intake port aligns with the intake port of the cylindrical member 32 and exhaust port aligns with the exhaust port of the cylindrical member. As shown in FIG. 2, the spacer 64 is disposed over the annular thrust bearing 60 and the sleeve bearing member 58. The cylinder head 14 then mounts flush on the upper surface of the cylinder 12 and the upper surface of the spacer 64.

Figure 12:
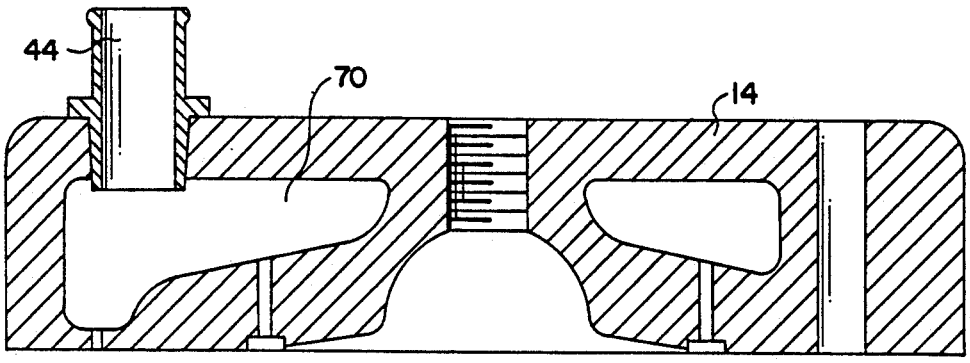
FIG. 12 is a cross-sectional view taken along the line 12—12 of FIG. 11.

As shown in FIGS. 2 and 12, the cylinder head 14 includes a water reservoir 70 which communicates with the water reservoir 40 of the cylinder. Further, the cylinder head 14 has a plurality of through bores 72 therein which align with threaded bores 74 in the cylinder 12. Bolts 76 are inserted through the bores and into the threaded bores to secure the cylinder head to the cylinder. In the illustrated embodiment, O-rings 80 are used to seal the cylinder head to the cylinder so that water circulating therethrough does not escape. The cylinder head also includes a threaded aperture 78 disposed axially therethrough for housing a spark plug (not shown).

The piston 20 is mounted for reciprocal movement within the cylinder member 32. As shown in FIG. 2, the piston has a piston shaft 82 which is operatively coupled to the crankshaft 22 at one end thereof. The crankshaft 22 converts the reciprocating motion of the piston to rotational motion. The piston has a piston dome 84 at a distal end thereof. The crankshaft 22 is of general conventional design, except that, in accordance with the invention, the crankshaft includes a crankshaft gear 86 mounted thereto. The gear 86 is bevel type and is engaged with a bevel-type shaft gear 88. The shaft gear 88 is coupled to shaft 90, disposed vertically within cylinder 12.

Figure 8:
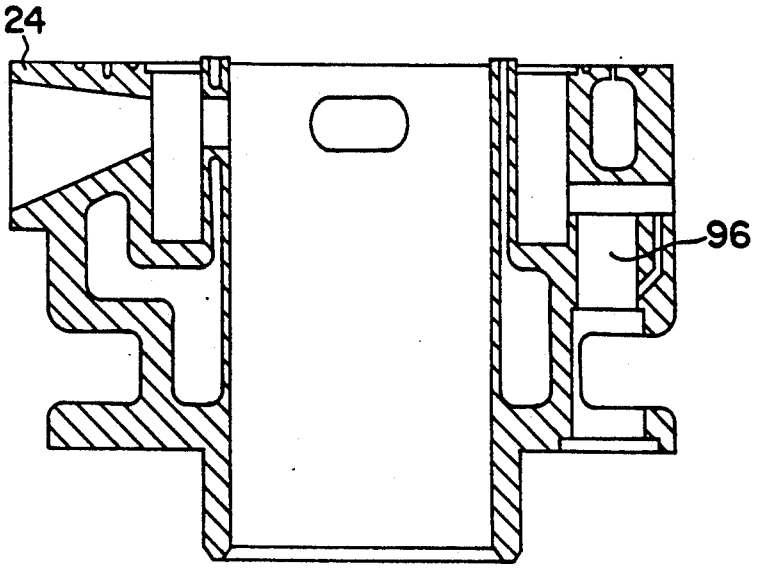
FIG. 8 is a cross-sectional view taken along the line 8—8 of FIG. 7.
Figure 9:
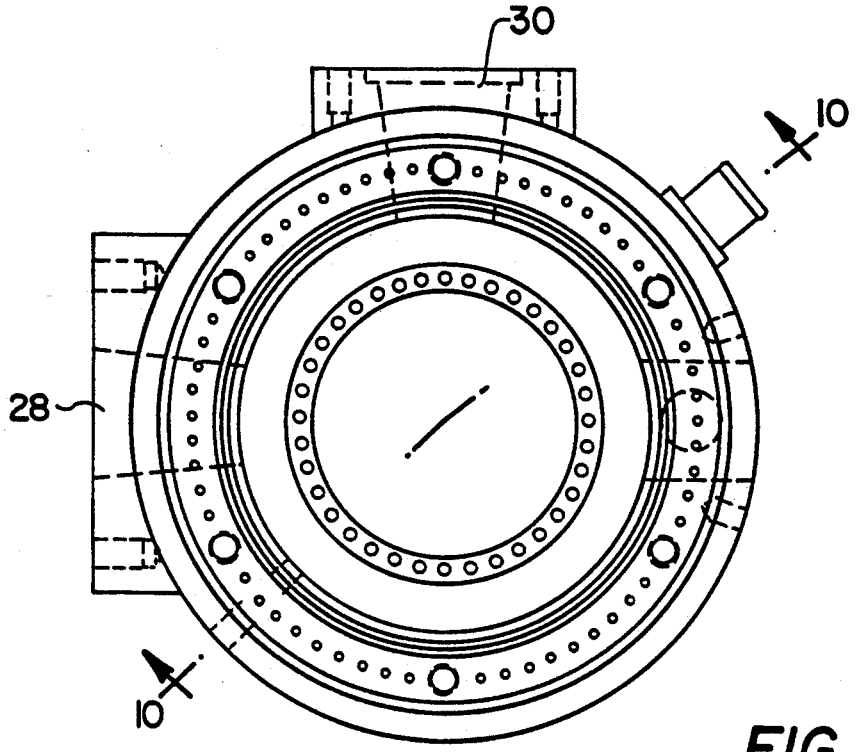
FIG. 9 is a plan view of the cylinder of the present invention.

The shaft 90 is rotatably mounted within the cylinder. To accomplish this, a mounting assembly, generally indicated at 92, is provided. The mounting assembly includes a bearing 94 disposed about the shaft, within shaft bore 96 (FIG. 8). Disposed beneath the shaft bearing 94 is a oil return tube 98. The oil return tube has an internal bore which is slightly larger than the diameter of the shaft so that oil may be distributed about the periphery of the shaft, as will become more apparent below. Disposed at the end of the shaft opposite the shear gear is a valve drive gear 100. The valve drive gear 100 is mounted so as to engage the gear teeth 54 of the sleeve rotary valve 16. As shown in FIG. 2, a cover plate 102 is provided so as to provide access to the valve drive gear.

Referring to FIG. 2, a oil feed line 104 is provided. A banjo-bolt 106 is coupled to the cylinder by threads. The banjo-bolt includes a bore therethrough which directs oil from the oil feed line to the sleeve gear teeth 54. The oil lubricates both the gear teeth of the sleeve 16 and the valve gear 100. The oil is not required for lubrication between the sleeve and the cylinder, however, oil can advantageously provide additional cooling of rotary parts. Further, as shown in FIG. 2, the oil is directed in the oil return tube via port 108 whereby the rotating shaft 90 is lubricated.

With reference to FIGS. 2 and 3, the operation of the sleeve-type rotary valve will be appreciated. Upon rotation of the crankshaft, the crankshaft gear 86 turns the shaft gear 88 and valve drive gear 100 at a 2:1 ratio. The valve drive gear in turn rotates the sleeve-type rotary valve 16 at a ratio of 1:4, in relation to the crankshaft 22. The rotary valve 16 in turn rotates so that slot 52 periodically aligns with the cylinder member ports 36, 38 to open and close the ports at a desired timing. Duration of the opening and closing of the ports can be slowed or accelerated by adjustment of the port size in either the cylinder or the rotary valve. Port timing can be altered by changing the spacing between the ports.

As can be appreciated from FIG. 2, the location of the intake and exhaust ports in the cylinder member ensures that fuel ignition takes place after top rings of the piston dome 84 have passed the cylinder members intake and exhaust ports, thus not placing an explosion stress directly on the valve 16. Thus, the valve is not exposed during ignition. Such a design is advantageous in that the valve does not experience severe stresses which may lead to sealing problems common in conventional rotary valves.

It can thus be appreciated that the sleeve-type rotary valve assembly of the present invention provides an effective valve arrangement for an internal combustion engine. The use of the carbon/graphite thrust bearing members to provide lubrication between the rotary valve and the cylinder reduces friction and thus increases the efficiency of the motor. Further, the provision of water cooling and the lubrication oil provides adequate cooling of the valve.

It has thus been seen that the objects of this invention have been fully and effectively accomplished. It will be realized, however, that the foregoing preferred embodiments have been shown and described for the purpose of illustrating the structural and functional principals of the present invention and are subject to change without departure from such principles. Therefore, this invention includes all modifications encompassed within the spirit and scope of the following claims.

What is claimed is:

1. An internal combustion engine comprising:

at least one cylinder having at least one inlet port and at least one exhaust port;

a piston mounted in said at least one cylinder for reciprocated movement therein, said piston having a piston rod;

a crankshaft coupled to said piston rod for converting the reciprocating motion of the piston into rotational motion;

a cylindrical sleeve surrounding an outside wall of a portion of said cylinder, said cylindrical sleeve having at least one slot defined therethrough which aligns periodically with said ports of said cylinder upon rotation of said cylindrical sleeve;

means for mounting said cylindrical sleeve for rotation relative to said cylinder, said mounting means including low-friction bearing structure disposed so as (1) to contact both said cylinder and cylindrical sleeve and (2) to prevent contact of said cylindrical sleeve with said cylinder, to minimize friction between said cylinder and said cylindrical sleeve; and means operatively coupling said cylindrical sleeve to said crankshaft for rotating said cylindrical sleeve upon rotation of said crankshaft.

2. The internal combustion engine according to claim 1, wherein said cylindrical sleeve includes an upper portion and a lower portion, said upper portion including said slot, said lower portion having gear teeth projecting therefrom.

3. The internal combustion engine according to claim 2, wherein said means for rotating said sleeve includes:

a first gear mounted on said crankshaft;

a second gear engaging said first gear, said second gear coupled to one end of a rotary shaft, and a sleeve gear coupled to the other end of said rotary shaft and engaged with said teeth of said cylindrical sleeve, whereby rotation of said crankshaft rotates said rotary shaft through engagement of said first and second gears, said shaft in turn rotating said sleeve gear which rotates said cylindrical sleeve.

4. The internal combustion engine according to claim 1, wherein said inlet and exhaust ports are disposed in said cylinder so that fuel ignition takes place after a top portion of said piston has closed said ports so as to reduce ignition stress on said cylindrical sleeve.

5. The internal combustion engine according to claim 3, further comprising means for lubricating said sleeve gear and said rotary shaft.

6. The internal combustion engine according to claim 5, wherein said lubricating means includes lubrication passageways for delivering lubrication oil.

7. The internal combustion engine according to claim 1, wherein said cylinder further includes a removable cylinder head.

8. The internal combustion engine according to claim 1, wherein said sleeve and said mounting means are disposed within an annular recess defined with said cylinder.

9. The internal combustion engine according to claim 8, wherein said mounting means further includes:

a cylindrical spacer disposed about an upper portion of said sleeve in said recess, said spacer defining at least one intake bore and at least one exhaust bore therethrough, each said bore being aligned with respective ports of said cylinder; and a cylindrical head coupled to an upper portion of said cylinder so as to be flush with an upper surface of said cylinder and said spacer, said low-friction bearing structure including:

a first bearing ring disposed between a bottom of said recess and a lower surface of said sleeve;

a second bearing ring disposed between a surface of said spacer and an upper end surface of said sleeve; and a cylindrical bearing sleeve disposed along the entire inner periphery of said sleeve, said bearing sleeve including a bearing port which aligns with said slot of said sleeve, said cylindrical head maintaining said sleeve and said mounting means within said recess, whereby rotation of said sleeve rotates said bearing sleeve therewith so as to prevent direct contact of said sleeve with said cylinder.

10. The internal combustion engine according to claim 9, wherein said first and second bearing rings and said bearing sleeve are made of a graphite and carbon composite.

11. The internal combustion engine according to claim 7, wherein said cylinder head and said cylinder include water reservoirs for cooling said cylinder.

12. The internal combustion engine according to claim 3, wherein means are provided for directing oil to said sleeve gear and said rotary shaft.

13. An internal combustion engine comprising:

at least one cylinder having at least one inlet port and at least one exhaust port;

a piston mounted in said at least one cylinder for reciprocated movement therein, said piston having a piston rod;

a crankshaft coupled to said piston rod for reciprocating said piston within said cylinder;

a cylindrical sleeve surrounding an outside wall of a portion of said cylinder, said cylindrical sleeve having at least one slot extending therethrough which aligns periodically with said ports of said cylinder upon rotation of said cylindrical sleeve;

means for mounting said cylindrical sleeve for rotation with respect to said cylinder, said mounting means including friction reducing structure disposed so as (1) to contact both said cylinder and cylindrical sleeve and (2) to prevent contact of said cylindrical sleeve with said cylinder, to reduce friction between said cylinder and said sleeve; and means operatively coupling said cylindrical sleeve to said crankshaft for rotating said cylindrical sleeve upon rotation of said crankshaft, said inlet and exhaust ports being disposed in said cylinder so that fuel ignition takes place after a top portion of said piston has moved past said ports so as to reduce ignition stress on said cylindrical sleeve.

14. A rotary valve assembly for an internal combustion engine, the engine including at least one cylinder having at least one inlet port and at least one exhaust port; a piston mounted in the at least one cylinder for reciprocated movement therein, said piston having a piston rod; a crankshaft coupled to the piston rod for converting the reciprocating movement of the piston to rotational movement, the rotary valve assembly comprising:

a cylindrical sleeve surrounding an outside wall of a portion of the cylinder, said cylindrical sleeve having at least one slot defined therethrough which aligns periodically with the ports of the cylinder upon rotation of said cylindrical sleeve;

means for mounting said cylindrical sleeve for rotation relative to said cylinder, said mounting means including low-friction bearing structure disposed so as (1) to contact both said cylinder and cylindrical sleeve and (2) to prevent contact of said cylindrical sleeve with said cylinder to minimize friction between said cylinder and said cylindrical sleeve; and means operatively coupling said cylindrical sleeve to said crankshaft for rotating said cylindrical sleeve upon rotation of said crankshaft.

15. The rotary valve assembly according to claim 14, wherein said cylindrical sleeve includes an upper portion and a lower portion, said upper portion including said slot, said lower portion having gear teeth projecting therefrom.

16. The rotary valve assembly according to claim 15, wherein said means for rotating said sleeve includes:

a first gear mounted on the crankshaft;

a second gear engaging said first gear, said second gear coupled to one end of a rotary shaft, and a sleeve gear coupled to the other end of said rotary shaft and engaged with said teeth of said cylindrical sleeve, whereby rotation of the crankshaft rotates said rotary shaft through engagement of said first and second gears, said shaft in turn rotating said sleeve gear which rotates said cylindrical sleeve.

17. The rotary valve assembly according to claim 14, wherein said sleeve and said mounting means are disposed within an annular recess defined within the cylinder.

18. The rotary valve assembly according to claim 17, wherein said mounting means further includes:

a cylindrical spacer disposed about an upper portion of said sleeve in the recess, said spacer defining at least one intake bore and at least one exhaust bore therethrough, each said bore being aligned with respective ports of the cylinder, said low-friction bearing structure including:

a first bearing ring disposed between a bottom of said recess and a lower surface of said sleeve;

a second bearing ring disposed between a surface of said spacer and a upper end surface of said sleeve; and a cylindrical bearing sleeve coupled to the entire inner periphery of said sleeve, said bearing sleeve including a bearing port which aligns with said slot of said sleeve, whereby rotation of said sleeve rotates said bearing sleeve therewith so as to prevent direct contact of said sleeve with the cylinder.

* * * * *